US007381476B2

(12) United States Patent
Reyal

(10) Patent No.: US 7,381,476 B2
(45) **Date of Patent: *Jun. 3, 2008**

(54) STRUCTURAL ELEMENT HAVING A METAL WALL OF GENERALLY TUBULAR SHAPE

(75) Inventor: Jean Pierre Reyal, Eragny (FR)

(73) Assignee: Imphy Ugine Precision, Puteaux (FR)

( * ) Notice: Subject to any disclaimer, the term of this patent is extended or adjusted under 35 U.S.C. 154(b) by 2 days.

This patent is subject to a terminal disclaimer.

(21) Appl. No.: 10/953,534

(22) Filed: Sep. 30, 2004

(65) Prior Publication Data

US 2005/0127142 A1 Jun. 16, 2005

Related U.S. Application Data

(62) Division of application No. 10/333,014, filed on Jan. 15, 2003, now Pat. No. 6,814,275.

(30) Foreign Application Priority Data

Jul. 17, 2000 (FR) ..... 00 09334

(51) Int. Cl.
*B21C 37/08* (2006.01)
*B21C 37/15* (2006.01)
*B21D 51/00* (2006.01)

(52) U.S. Cl. ..... 428/582; 428/595; 428/598; 428/599; 428/603; 138/171; 220/62

(58) Field of Classification Search ..... 428/582
See application file for complete search history.

(56) References Cited

U.S. PATENT DOCUMENTS 1,394,134 A * 10/1921 Aberle ..... 229/149

(Continued)

FOREIGN PATENT DOCUMENTS

EP 208 564 1/1987

(Continued)

OTHER PUBLICATIONS

Derwent abstract for SU 1406053, Jun. 30, 1988, 3 pages.*

(Continued)

*Primary Examiner*—John J Zimmerman
(74) *Attorney, Agent, or Firm*—Sughrue Mion, PLLC

(57) ABSTRACT

At least one plane blank (20) is cut out from a sheet of metal material, the blank comprising a main part having the developed shape of the wall of the structural element and at least one additional overlap and fixing tab (26, 27, 28), the cutout blank (20) is folded along a plurality of lines (23) so as to form the wall of the structural element comprising a plurality of annular segments that are not in axial alignment out of folded portions (22, 24, 24', 25) of the main part of the cutout blank (20), and welding is used to fix at least one additional overlap and fixing tab (26, 27, 28) on at least one of a folded portion (22, 24, 24', 25) and a second overlap tab. During welding, at least one overlap tab (26, 27, 28) and the folded wall portion (22, 24, 24', 25) or the second overlap tab are maintained bearing resiliently one against the other in a superposed disposition, welding is perfectly performed by means of a laser beam, in transparency, the structural element of the invention has numerous applications in a very wide variety of industries.

1 Claim, 7 Drawing Sheets

U.S. PATENT DOCUMENTS

| | | | | | |
|---|---|---|---|---|---|
| 1,651,542 | A | * | 12/1927 | Pittman | 126/39 B |
| 1,775,717 | A | * | 9/1930 | Everhard | 160/228 |
| 1,823,710 | A | * | 9/1931 | Thompson | 229/149 |
| 1,934,372 | A | * | 11/1933 | O'Connor | 108/161 |
| 2,074,987 | A | | 3/1937 | Lagerblade | |
| 2,242,468 | A | * | 5/1941 | Holub | 285/183 |
| 2,483,464 | A | * | 10/1949 | Johnson | 229/115 |
| 2,608,458 | A | * | 8/1952 | Simpson | 312/329 |
| 2,681,174 | A | * | 6/1954 | Bergstein | 229/161 |
| 2,713,452 | A | * | 7/1955 | Williamson | 229/117.08 |
| 2,791,363 | A | * | 5/1957 | Boeye | 206/527 |
| 2,963,783 | A | * | 12/1960 | Field | 428/581 |
| 3,186,528 | A | * | 6/1965 | Bohnsack | 49/503 |
| 3,271,357 | A | * | 9/1966 | Burt | 206/778 |
| 3,287,041 | A | * | 11/1966 | Cohen | 52/658 |
| 3,543,464 | A | * | 12/1970 | Taylor | 52/455 |
| 3,558,858 | A | | 1/1971 | Luger, Jr. | |
| 3,978,982 | A | * | 9/1976 | Duncan | 206/326 |
| 4,030,525 | A | | 6/1977 | Bassler et al. | |
| 4,193,238 | A | | 3/1980 | Chalmers et al. | |
| 4,223,196 | A | | 9/1980 | Erlandson et al. | |
| 4,248,373 | A | | 2/1981 | Linse et al. | |
| 4,916,284 | A | * | 4/1990 | Petrick | 219/121.64 |
| 5,018,263 | A | | 5/1991 | Stern | |
| 5,253,799 | A | * | 10/1993 | Sebesta | 229/108 |
| 5,571,280 | A | * | 11/1996 | Lehrer | 362/352 |
| 6,037,556 | A | | 3/2000 | Rudd | |
| 6,290,125 | B1 | * | 9/2001 | Breda | 229/120.07 |
| 6,528,933 | B1 | * | 3/2003 | Reyal | 313/407 |
| 6,675,969 | B1 | * | 1/2004 | Kiyohara et al. | 206/448 |

FOREIGN PATENT DOCUMENTS

| | | | |
|---|---|---|---|
| EP | 0765994 A1 | * | 4/1997 |
| EP | 780 173 | | 6/1997 |
| JP | 2000-260344 | * | 9/2000 |
| WO | WO 90 07392 | | 7/1990 |
| WO | WO 00/38997 | * | 7/2000 |
| WO | WO 00/51157 | * | 8/2000 |

OTHER PUBLICATIONS

Derwent abstract for SU 1155503, May 15, 1985, 2 pages.*
Patent Abstracts of Japan, vol. 1995, No. 7, Aug. 31, 1995 & JP 07 100528, Nisshin Steel Co., LTD., Apr. 18, 1995.

* cited by examiner

STRUCTURAL ELEMENT HAVING A METAL WALL OF GENERALLY TUBULAR SHAPE

This is a divisional of application Ser. No. 10/333,014 filed Jan. 15, 2003, now U.S. Pat. No. 6,814,275.

BACKGROUND OF THE INVENTION

The invention relates to a method of manufacturing a structural element having a metal wall of generally tubular shape with at least two segments that are not in axial alignment, and it also relates to a tubular metal-walled structural element suitable for being made in a very wide variety of shapes and for a very wide variety of applications.

In numerous industrial sectors, it is necessary to have structural elements of generally tubular shape, that comprise successive segments that are not in axial alignment, and that are of cross-section that is more or less complex in shape, and in particular that is polygonal.

Such structural elements may be curved or may present successive segments that are rectilinear in angular dispositions, for example extending at right angles to one another, when providing structural elements in the form of square or rectangular frames.

In certain applications, it is necessary to have frames presenting high stiffness and mass that is as low as possible, with these two conditions generally being difficult to reconcile when making frames by assembling together tubular section members of polygonal section. In order to assemble and weld together the sides of the frame at its corners, it is necessary to use tubes having walls of sufficient thickness. As a general rule, it is difficult to make frames by assembling tubes together, e.g. tubes of square section, if they have wall thickness that is less than 1 millimeter (mm).

In certain applications, for example in making metal doors, it can be desirable not only to obtain good stiffness and mass that is as light as possible, but also to obtain qualities making the door appealing to the eye, for example when the door is used in a building where a particular decorative style is implemented. Under such circumstances, it can be necessary to provide framework structures with different sides presenting sections of various shapes. It is therefore necessary to have tubes with sections of different shapes and possibly shapes that are most unusual. This makes the construction of such doors very expensive.

In certain industries, for example the automobile industry, the aviation industry, or the ship-building industry, structural elements or "chords" are used that are light in weight, that have tubular metal walls, that are complex in shape, and that may be curved or even looped back onto themselves in order to constitute an annular piece. Such structural elements whose tubular structure serves to obtain savings in weight must be built in a manner that is extremely stiff and strong.

In order to make such complex structures, it is generally necessary to assemble together a large number of pieces that have previously been shaped by a forming and/or cutting-out method. Assembling pieces together to make a structure of complex shape, and to do so with good precision both in shape and in dimensions, is an operation that is expensive, and the various welds used to build the assembly must be inspected thoroughly.

In addition, when the metal material used is difficult to weld, such as aluminum and its alloys, it is even more difficult and expensive to make complex structures, and it may be necessary to use assembly methods that are difficult to implement in order to avoid the presence of welding.

When making structural elements from flat materials such as metal sheets, blanks are generally cut out and assembled together by being welded along their edges, which generally requires the use of jigs and supports for holding the blanks in their assembly position. Such structures are therefore complex to make and require the use of tooling that is expensive. In addition, in certain circumstances, it is not even possible to use a jig placed in a hollow portion of the tubular structure because the shape of the structure would prevent the jig from being removed after the structure has been assembled and welded together.

SUMMARY OF THE INVENTION

The object of the invention is thus to propose a method of manufacturing a structural element having a metal wall of generally tubular shape comprising two segments that are not in axial alignment, which method is simple to implement and of limited cost, and makes it possible to make structures that are complex in shape, stiff, and lightweight, out of any metal material.

For this purpose, the method comprises the steps of:

cutting out at least one plane blank from a sheet of metal material, the blank having a main part having the developed shape of the segments of the wall of the structural element, and for each of the segments, at least one overlap and fixing tab, together with at least one additional tab for fixing segments together;

folding the cutout blank along a plurality of lines so as to form the wall of the structural element out of folded margins of the main part of the cutout blank; and using welding to fix at least one additional overlap and fixing tab of each of the segments to at least one additional tab for fixing segments together over at least one of a folded margin of the wall of the structural element or a second overlap tab, the at least one additional overlap and fixing tab of each segment and the at least one tab for fixing segments together and the folded margin of the wall or the second overlap tab being maintained to bear resiliently one against the other.

In order to make the invention well understood there follows a description of various implementations of the method of the invention given as examples and also of structural elements having characteristics that are quite novel and that can be obtained by the method.

DETAILED DESCRIPTION OF THE INVENTION

Figure 1:
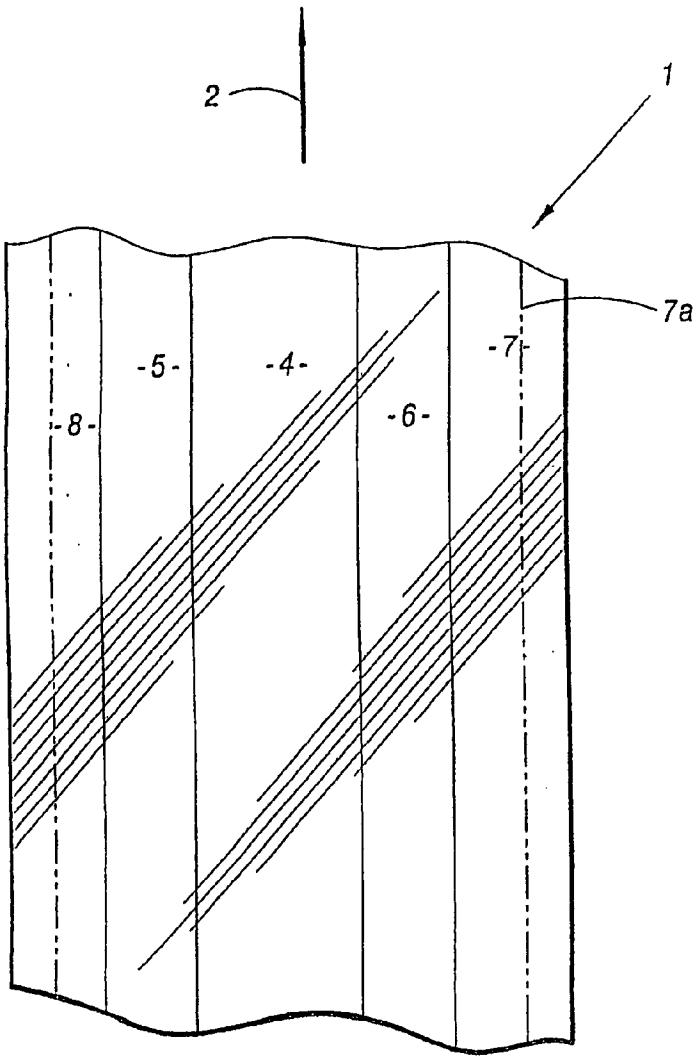
FIG. 1 is a plan view of a fraction of a cutout blank which can be implemented in manufacturing an upright of polygonal section for a framework structure of the invention.

FIG. 1 shows a fraction of a metal blank given overall reference 1, this fraction of the blank 1 being for use in making a portion of a segment constituting the side of a frame of polygonal section, itself constituting a structural element of the invention.

Figure 2:
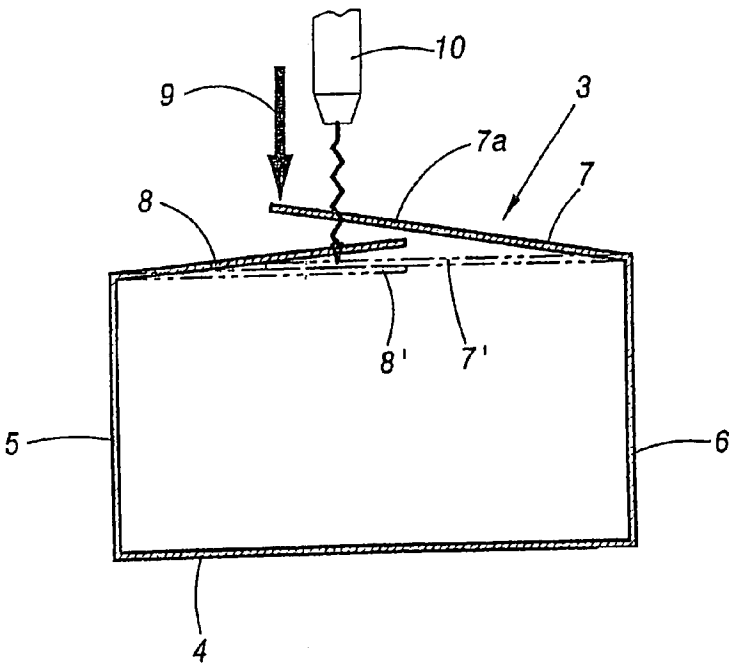
FIG. 2 is a diagrammatic cross-section view of the polygonal section upright as made by folding the blank shown in FIG. 1, the upright being shown in a stage prior to welding a connection and fixing tab.

The metal blank 1 as a whole has extensions of the fraction shown in FIG. 1 in the longitudinal direction 2 and other fractions for constituting other sides of the frame by folding, said other sides optionally presenting cross-sections of polygonal shape different from the shape of the section of the segment shown in FIG. 2.

The sole purpose of FIGS. 1 and 2 is to explain the principle of the manufacturing method of the invention, without describing the process of manufacturing a structural element in full.

The segment of metal blank 1 shown in FIG. 1 is in the form of a rectangular strip extending in the longitudinal direction 2 and presenting width that is sufficient for making the section of one side of a rectangular-shaped frame as shown in FIG. 2.

A first operation in manufacturing the frame consists in cutting the blank 1 out from a sheet of metal material of a desired kind and thickness.

In general, and as explained below, the method of the invention enables structures to be made that are generally tubular in shape having wall thickness that can be small, for example lying in the range 50 micrometers (μm) to 1 mm, it being impossible to make such thin-walled structural elements using known methods such as angular assembly of tubes.

The fraction of the metal blank 1 that is to constitute the upright 3 of the frame whose section is shown in FIG. 2 has fold lines drawn thereon that are all parallel to the longitudinal direction 2 and that define five portions of metal blank given respective references 4, 5, 6, 7, and 8 and that are in the form of rectangular strips. The fraction of blank 1 shown in FIG. 1 having the fold lines drawn thereon between the various strip portions of the blank constitute the developed shape of the section of the side of the frame 3 shown in FIG. 2. Folding is performed as shown in FIG. 2 so that the blank strip portions 5 and 6 folded upwards at 90° relative to the strip portion 4 constitute two side faces of the side of the frame and the inwardly-folded strip portions 7 and 8 of the side section 3 of the frame constitute two flaps that are to be superposed in positions 7' and 8' so as to constitute the top wall of the side 3 of the frame.

As shown in FIG. 2, the strip portions 7 and 8 of the metal blank are folded inwards so that the flap 8 is situated beneath the flap 7 and so that the flaps 7 and 8 leave a residual open angle relative to their closed position 7' and 8'.

The strip portions 7 and 8 are assembled together by being caused to overlap and by being fixed together by applying a force 9 to the flap 7 in a vertical direction urging it towards the flap 8 from the outside towards the inside of the section of the side of the frame 3.

Under the effect of the force 9, the flap 7 pivots about the fold line and presses against the flap 8 which in turn pivots about its fold axis. The distance through which the flaps 7 and 8 are moved is determined so as to constitute the top wall of the side 3 of the frame by superposing the flaps in coplanar positions 7' and 8'.

The flap 7' is held in place by the thrust element applying the force 9, and the flap 8 when in its position 8' presses resiliently against the bottom face of the flap 7' so that in their positions 7' and 8' the flaps 7 and 8 are flat against each other and press resiliently against each other.

The fraction of the top flap 7 extending between the free edge of the flap 7 and the line 7*a* where it presses against the free edge of the flap 8 in the flat position constitutes an overlap and fixing tab of the metal blank for closing the tubular structure. To fix the flaps 7 and 8 together, it is possible to use a welding installation such as a laser welding head 10, whereby a plurality of weld spots or lines can be made in the longitudinal direction 2 between the superposed flat portions 7 and 8, i.e. between the overlap tab of the flap 7 and the portion of the flap wall 8 that is covered by the overlap tab. Such welding performed in the thickness of the overlap tabs of the flaps 7 and 8 by means of a laser beam can be referred to as "transparency" welding.

It is also possible to weld the flaps 7 and 8 together along the free edge of the flap 7 as superposed on the flap 8 in their assembled-together position 7', 8', but such welding along the edge of the flap 7 requires more accurate control over the direction and positioning of the welding beam than does transparency welding via spots or linear zones placed arbitrarily in the overlap tabs of the flaps 7 and 8 in their assembled-together position.

As soon as the overlap tab has been welded over a fraction of the wall of the structure, the structure becomes stiff because relative sliding of the overlap tab on the wall becomes impossible.

Thus, in the very simple example shown in FIGS. 1 and 2, it can be seen that a segment of the structure, e.g. one side of a frame of polygonal section of arbitrary shape, can be made in a manner that is simple, merely by folding, pressing an overlap tab elastically against a wall portion, and then welding the overlap tab to the covered wall portion, e.g. by using a laser.

Naturally, it is possible to use welding means other than a laser torch for making spots or lines of welding, nevertheless the welding device should be capable of performing welding from outside the structure, and of doing so without making contact with the walls of the structure.

When welding walls of a frame-shaped structure having a wall thickness of less than 1 mm, for example of about 0.7 mm, it is possible to perform high quality welding by means of a laser using a yttrium aluminum garnet (YAG) laser, even when the superposed metal sheets "swell" in thickness by a value that may be as great as 0.2 mm. The term "swelling" is used with respect to a stack of sheets to designate the extra thickness of the stack compared with the sum of the thicknesses of the superposed sheets. The swelling corresponds to the mean thickness of the layer of air between the superposed sheets, which air is present because the sheets are not perfectly plane.

The method of the invention can thus be implemented with industrial sheet metal of planeness such that there exists a certain amount of swelling when sheet metal portions are stacked.

Two ways of making a generally tubular structure by folding a metal blank cut out from a sheet such as sheet metal or foil are described below as examples, these two implementations merely illustrating the method of the invention which is described in very general manner above with reference to FIGS. 1 and 2.

Naturally, the method of the invention can be applied to making numerous structural elements of generally tubular shape presenting a very wide variety of characteristics and uses.

Figure 3:
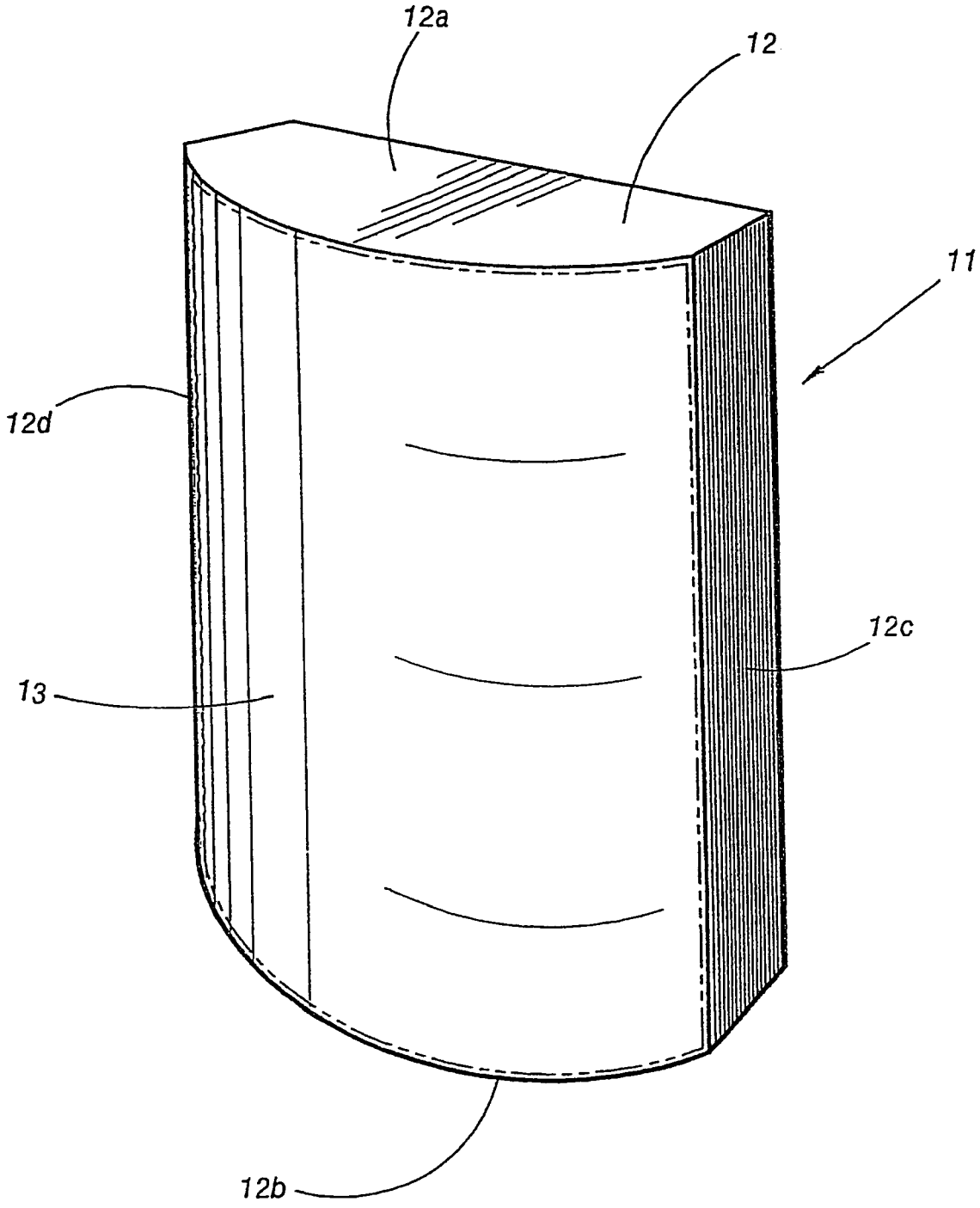
FIG. 3 is a perspective view of a door having a rounded surface made by the method of the invention.

A first device incorporating a structural element made in accordance with the invention is shown in FIG. 3.

FIG. 3 shows a metal door given overall reference 11 and comprising a generally rectangular framework 12 with sides presenting tubular structure and made by the method of the invention.

The framework comprises two horizontal sides, a top side 12*a* and a bottom side 12*b*, and two vertical lateral sides, respectively 12*c* and 12*d*.

The top and bottom sides 12*a* and 12*b* are made in the form of tubes presenting a cross-section that is triangular, while the lateral sides 12*c* and 12*d* are likewise made in the form of tubes, but presenting a cross-section that is rectangular. The end edges of the top and bottom sides 12*a* and 12*b* that are interconnected along the angles of the triangular cross-sections constitute respective curved surfaces on which there can be fixed the top and bottom ends respectively of a door face 13, which thus presents a rounded shape. The face 13 may be constituted by a single metal sheet that is applied and fixed by welding along the curved edges of the two sides 12*a* and 12*b* of the framework of the door.

As explained below with reference to FIGS. 4, 5, 6, and 7, the framework 12 of the door can be made by the method of the invention, merely by cutting out and folding a metal blank so as to constitute the walls of the framework, with overlap tabs of the walls enabling folded portions of the framework to be assembled and fixed together and enabling the sides of the framework to be fixed to one another, so as to make the closed structure shown in FIG. 3.

The facing sheet 13 is then put into place and fixed by being welded to the edges of the framework, and in particular by being welded along the top and bottom curved edges. This provides a rounded metal door built on framework presenting sides having differently-shaped sections, thus making it possible to improve the appearance of the door and given it an original look.

Such a door can be used for closing cupboards or equipment rooms or to close dwellings.

Framework of the kind shown in FIG. 3 which is made as described below with reference to FIGS. 4 to 7 can be made not only in such a manner as to constitute the framework of a door, but also to make a frame that is suitable for use, for example, in a silkscreen printing machine. Under such circumstances, the frame which is made in lightweight and stiff manner can easily serve to fix and tension a silkscreen which is fixed along the edges of the frame.

It is also possible to tension the screen on the frame by exerting force between the top and bottom sides 12*a* and 12*b* while putting the screen into place and then relaxing the applied force on the end sides after the screen has been fixed.

Figure 4:
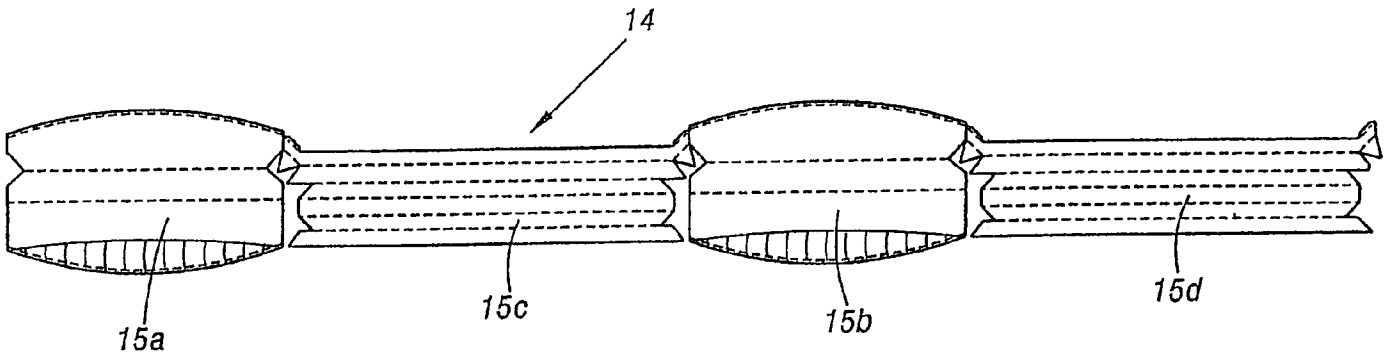
FIG. 4 is a plan view of a metal sheet cut out for making the door structure shown in FIG. 3.
Figure 5:
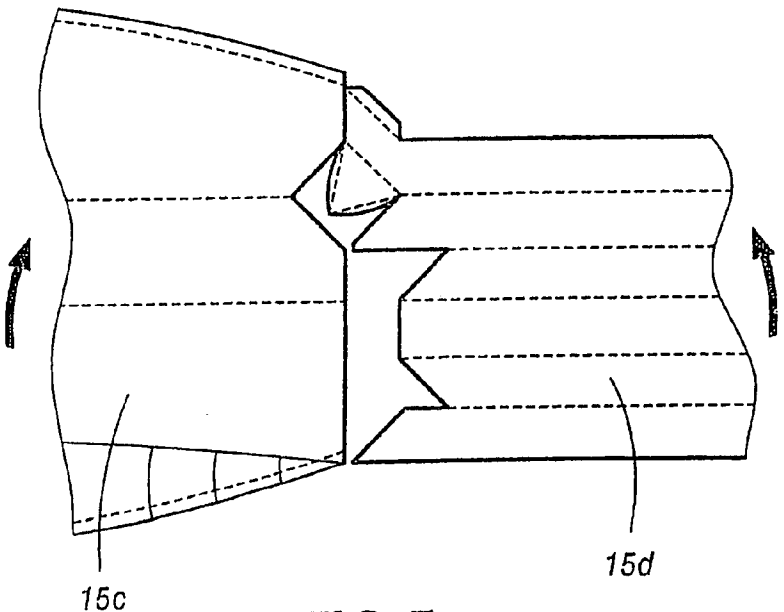
FIG. 5 is an enlarged view of a fraction of the blank shown in FIG. 4.

FIG. 4 shows a metal blank given overall reference 14 which has been cut out from a metal sheet or foil, so as to form an elongate strip having cutouts between each of the fractions of the strip that are to constitute a particular side of the framework.

The walls of the end sides 12*a* and 12*b* of the framework are made from fractions 15*a* and 15*b* of the elongate strip-shaped blank 14, while the rectangular section lateral sides 12*c* and 12*d* are made from fractions 15*c* and 15*d* of the blank 14.

Dashed lines in FIG. 4 represent the fold lines for the strip fractions 15*a*, 15*b*, 15*c*, and 15*d* on which folding is performed to make the corresponding sides of the framework that is generally tubular in section, which sections are respectively triangular and rectangular.

Each of the fractions 15*a*, 15*b*, 15*c*, and 15*d* of the blank has a main strip part constituting a plane development of the side of the framework, and overlap and fixing tabs that are used for closing and fixing the sides of the frame and for fixing the sides of the frame to one another.

The fractions 15*a* and 15*b* comprise three plane wall portions joined via mutually parallel fold lines for constituting the three faces of the sides of the framework that are triangular in section, together with two longitudinal edges that are to overlap so as to enable the end sides of the framework to be assembled and fixed. The two longitudinal edges of the fractions 15*a* and 15*b* of the metal blank are defined by respective curved lines and the bottom edges are slightly dished so as to enable the two assembled-together edges to engage, the dished portions also serving to stiffen the edges of the framework that is used in particular for having a door face or a printing screen fixed thereto.

The fractions 15*c* and 15*d* of the metal blank comprise respective main parts constituted by four longitudinally-extending wall portions joined together by fold lines so as to constitute the four faces of the wall of the rectangular section side of the framework, and two overlap tabs that are to be superposed on two folded portions constituting two faces making up the side of the framework that is generally rectangular in shape.

The cutouts between the successive fractions of the metal blank 14 are made in such a manner that after folding, the ends of the lateral sides of the framework are received in the end sides of triangular section and that each of the corners of the framework is broken. In addition, cutting is performed in such a manner as to leave tabs and flaps constituting overlap and fixing tabs for the walls of the framework and between the sides of the framework.

Figure 6:
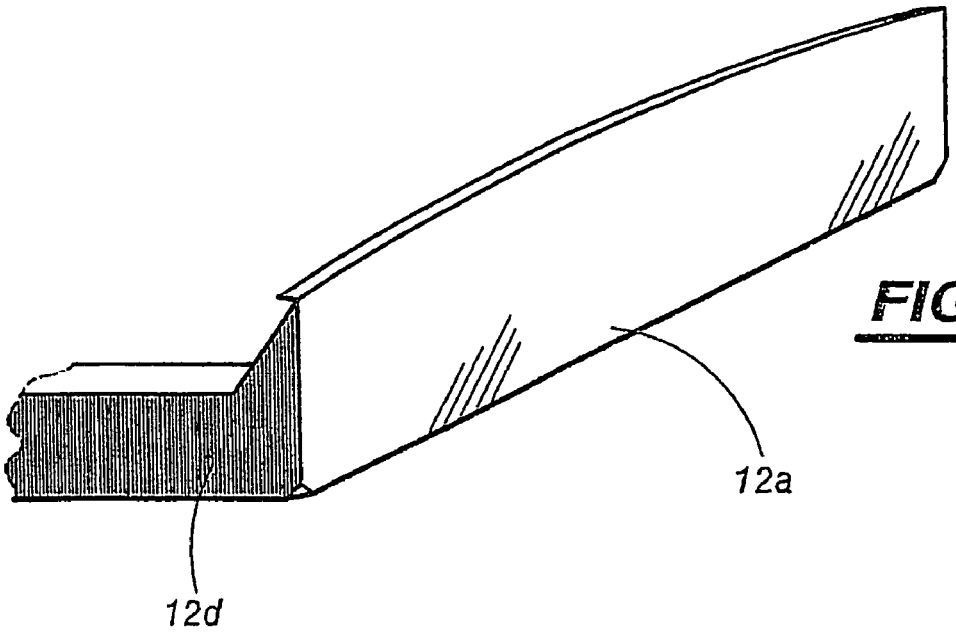
FIGS. 6 and 7 are fragmentary perspective views of the door structure made by folding and welding the metal blank shown in FIG. 4.
Figure 7:
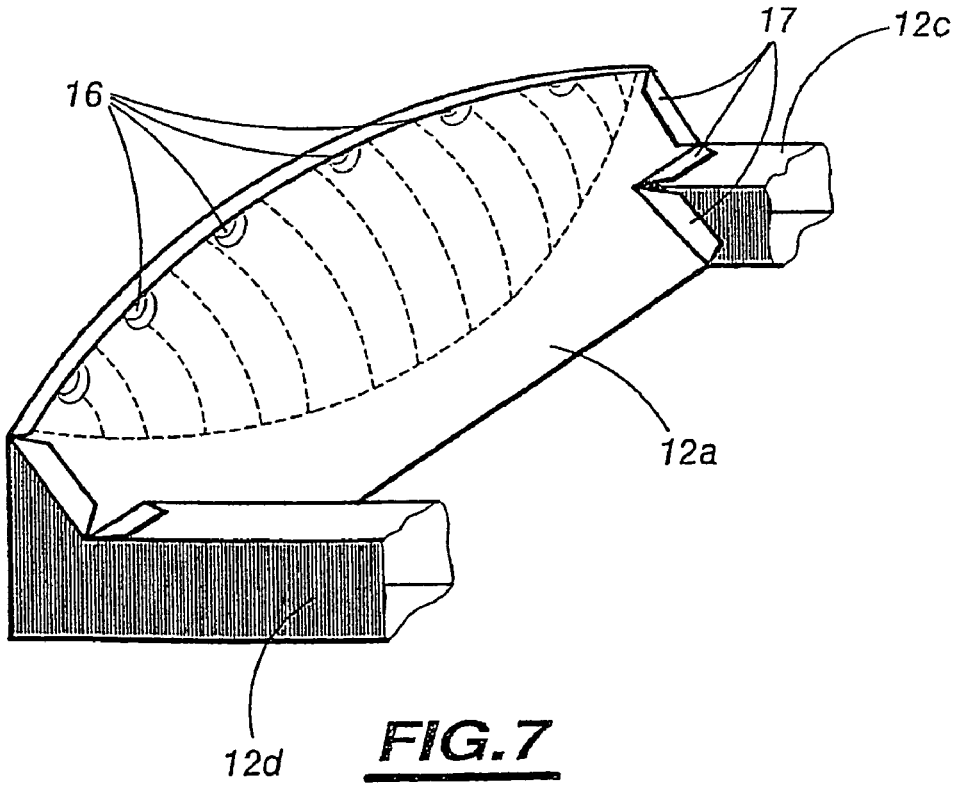

FIGS. 6 and 7 show respectively the outside and the inside of an end side of the framework together with the ends of the two lateral sides that are received inside the end side after the blank 14 has been folded along the fold lines shown.

When the framework in the disposition it takes on after being folded, as shown in FIG. 7, the tubular walls of each of the sides of the framework are fixed together by means of the overlap tabs which are caused to bear resiliently either against portions of the blank that constitute the wall portions for the sides of the framework or else against other overlap tabs.

As mentioned above, the overlap tabs are constituted by the longitudinal outside edges of the fractions 15*a* and 15*b* which are placed facing each other during folding and are held pressed elastically against one another during the welding operation which is performed, for example, in transparency by a laser beam at spots or along lines of welding that are distributed along the length of the edges that are made to coincide and press resiliently against one another.

In FIG. 7, there can be seen connection zones 16 constituted by dished depressions made in each of the edges for connection of the end sides of the framework and engaged one in the other while resiliently pressing the two edges to be assembled together one on the other. The weld lines may be made in the depressions 16 in a direction parallel to or perpendicular to the edges of the end side of the framework, thus assembling them together.

When assembling and closing the lateral sides of the framework, the overlap tabs constituted by the two strip-shaped portions overlap two portions constituting faces of the walls of the lateral sides. By applying thrust force on these overlap tabs, it is possible to cause the overlap tabs to bear resiliently against the folded portions constituting the faces of the lateral sides. The overlap tabs are then welded to the folded portions constituting the faces of the walls of the framework, e.g. by welding in transparency, using a laser beam or by electric welding. The lateral sides of the framework can be assembled and fixed together by spots or lines of welding that are spaced along the length of the lateral sides.

The welding of the sides of the framework can be performed simply and quickly using a limited number of weld spots or lines that are distributed along the length of the sides of the framework in the junction zone. The overlap tabs can be caused to bear resiliently one on another or on a wall portion, thereby achieving satisfactory contact during welding so as to guarantee a strong joint.

As shown in particular in FIG. 7, the lateral sides are fixed to the end sides by overlap tabs constituted by flaps or tabs 17 in the junction portions of the end sides or the lateral sides of the framework. The flaps 17 constituting additional overlap tabs of the end side walls are caused to bear resiliently against the walls of the lateral sides while transparency welding is performed by laser on the flaps 17 overlying the walls. Similarly, the flaps 17 constituting the additional tabs on the walls of the lateral sides are caused to overlap and bear resiliently against walls of the end sides while welding in transparency is performed by laser.

Using welding to connect together overlap tabs and additional overlap tabs or walls of the framework makes it possible to obtain an assembly that is perfectly stiff, even when using a metal blank that is thin, for example a metal blank having thickness of about 0.7 mm or even 0.5 mm.

In some circumstances, it is even possible to envisage making the framework by cutting out and folding sheet metal of thickness lying in the range 0.05 mm to 0.5 mm.

Such a framework can find numerous applications whenever it is desired to have both good stiffness and low mass, for example when made out of material that is expensive.

Under other circumstances, it is necessary to obtain very high levels of stiffness and strength for hollow structures of generally tubular shape that might present an outline that is complex in shape.

With such structures where very high strength is required, it is possible to use metal blanks that are relatively thick, for example metal blanks of thickness greater than 1 mm in order to constitute the walls of the hollow structure and the overlap tabs used for assembly purposes after the structure has been folded.

Figure 8:
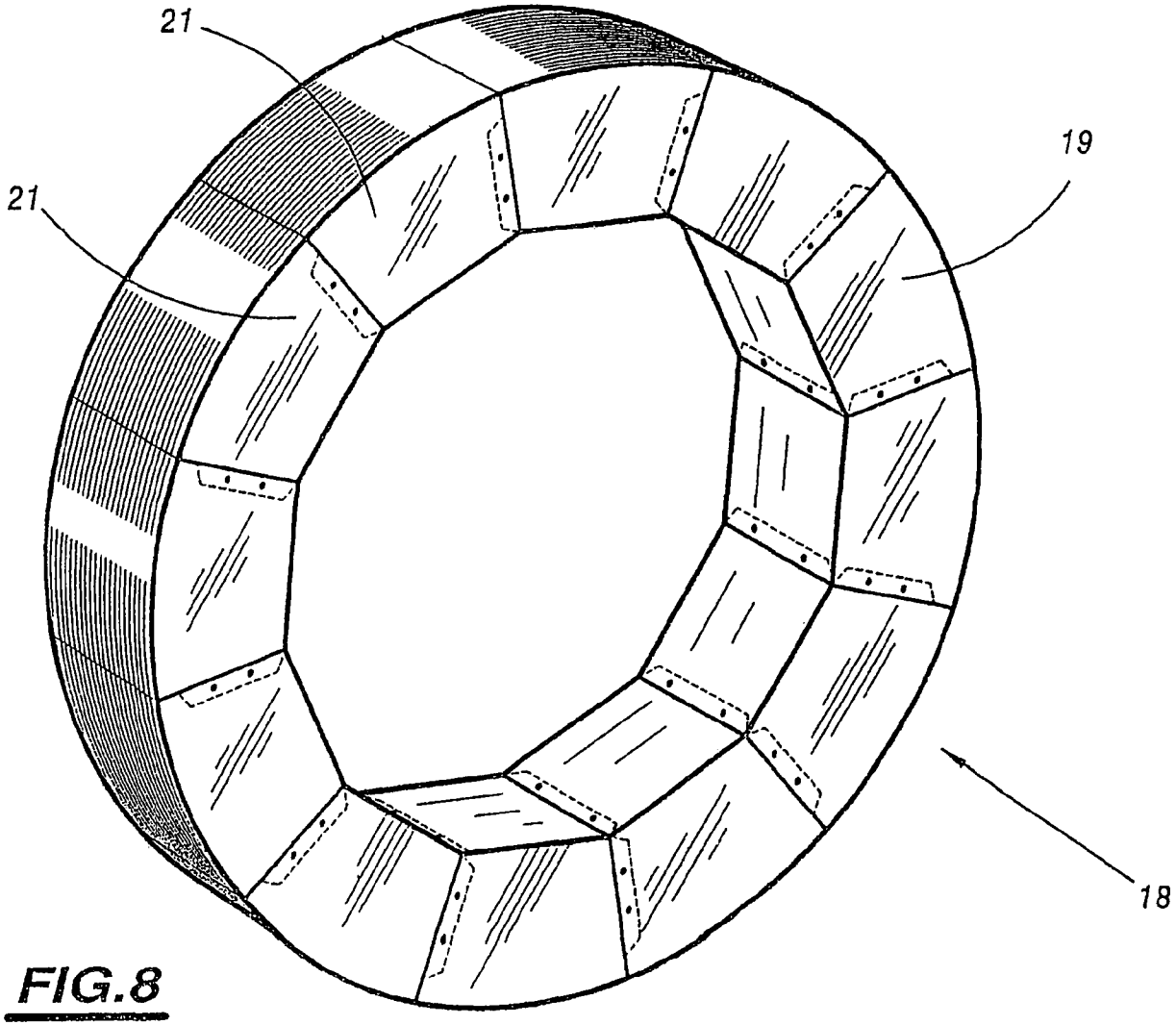
FIG. 8 is a perspective view of a structural element of annular shape which can be made by the method of the invention.

FIG. 8 shows a piece of annular structure and generally tubular shape which can be made by the method of the invention using a single blank or strip of metal folded to constitute the walls of the structure and also constituting overlap and fixing tabs.

In general, the piece 18 shown in FIG. 8 is in the form of a ring which may be of large dimensions, and which is of hollow cross-section that is generally rectangular in shape.

The piece 18 is made up of successive annular segments 19 of angular amplitude adapted to the method of manufacture described below and that are connected together by spots or lines of welding made on overlap tabs bearing resiliently against wall portions of the structural element.

For example, an annular piece 18 of the kind shown in FIG. 8 can be designed to have twelve segments 19, each occupying an angular amplitude of 30°.

Figure 9:
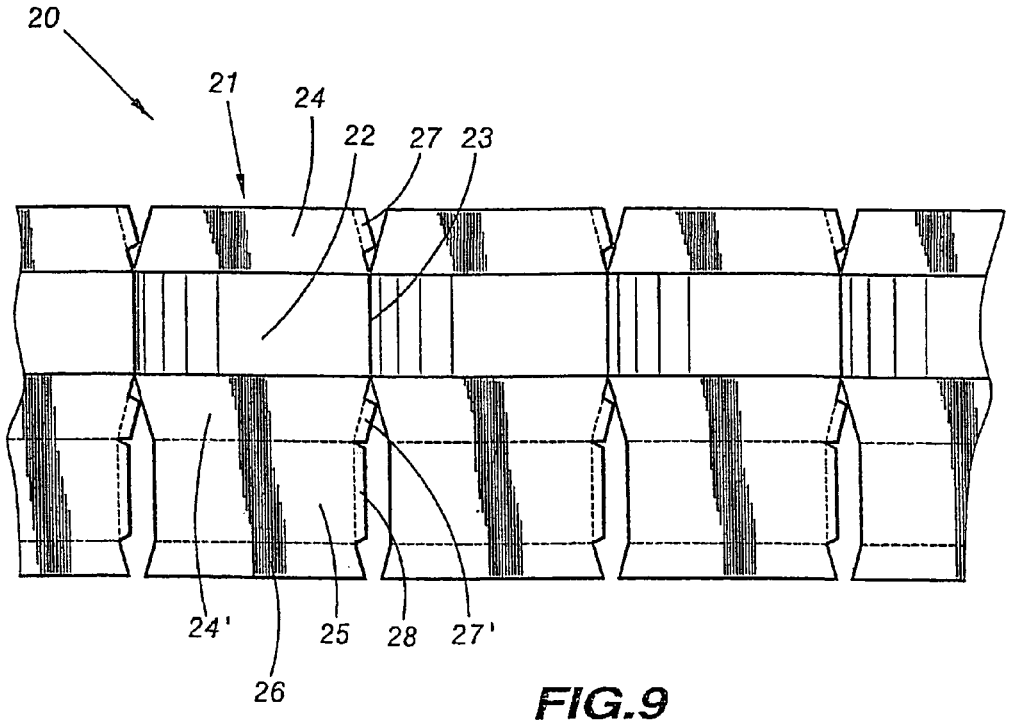
FIG. 9 is a plan view of a fraction of a metal blank for making the structural element shown in FIG. 8.
Figure 10:
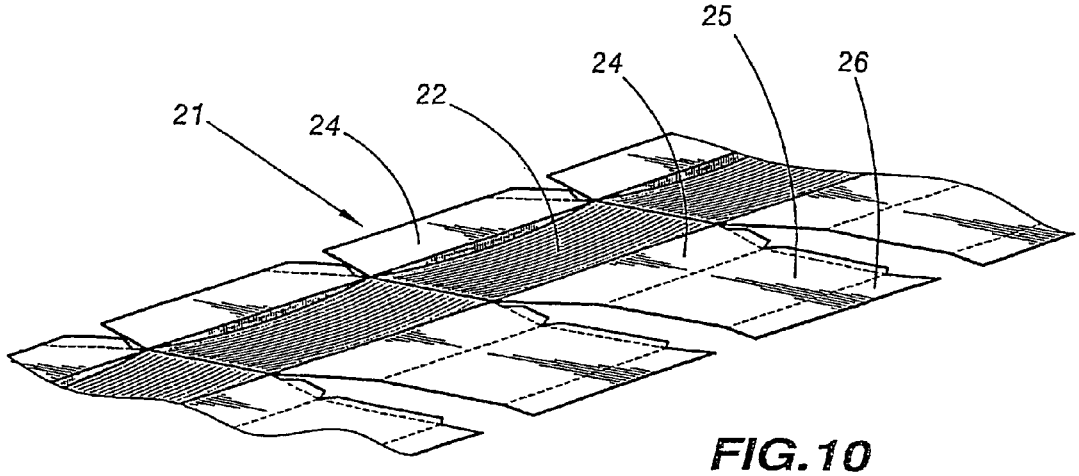
FIG. 10 is a perspective of a fraction of one of the faces of the blank shown in FIG. 9.

FIG. 9 shows a fraction of a metal blank for use in making the structural element shown in FIG. 8 by folding and by welding.

The metal blank shown in part in FIG. 9 is given overall reference 20.

Each of the segments 19 of the metal structure is made from a section 21 of the metal blank 20.

Each section 21 has a strip 22 for constituting a wall portion of the outer cylindrical surface of the annular structural element 18 over one segment 19.

A succession of stamped zones 22 are made in a longitudinally-extending strip of the blank 20 cut from a sheet of metal, each of the zones 22 forming a fraction of a cylindrical surface of longitudinal section in the form of a circular arc extending over 30°.

The stamped strips 22 are joined to one another via fold lines or zones 23 extending transversely and spaced apart from one another in the longitudinal direction of the strip-shaped blank 20.

The successive stamped zones can be made by a stamping machine comprising, for example, a wheel or cylinder having successive cylindrically-shaped convex stamping zones separated from one another by transverse depressions.

In the transverse direction on either side of each of the strips 22 of a section 21 of the blank 20, there are formed two trapezoidally-shaped wall portions 24 and 24' for constituting two side surfaces of the generally tubular wall of the annular piece 18. The wall portions 24 and 24' are joined to the stamped strip 22 via longitudinally-extending fold lines.

One of the wall portions (24') is extended by a wall portion 25 of length equal to the length of the minor bases of the walls 24 and 24' and of width substantially equal to the width of the stamped strip 22. The wall portion 25 is to constitute a prismatic inner wall portion of the annular piece 18. Finally, the wall portion 25 is extended by an additional overlap tab 26 for closing the tubular section 19 once the section 21 has been folded and assembled.

In addition, each of the wall portions 24 and 24' includes on one of its sloping lateral sides, a respective fixing and overlap tab constituted by a flap 27 or 27'.

Similarly, the wall portion 25 has an overlap tab on one of its lateral sides constituted by a flap 28.

The wall portions 24', 25, and 26 are joined to one another via fold lines extending in a longitudinal direction.

Figure 11:
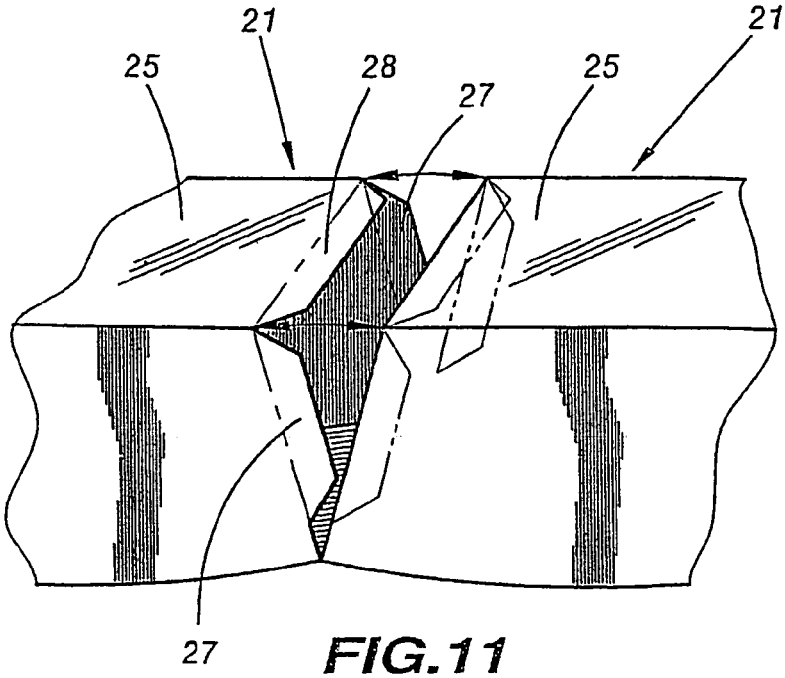
FIGS. 11 and 12 are perspective views of a fraction of the structural element shown in FIG. 8 during a folding stage and during an assembly stage of the method of the invention.

FIG. 11 shows two successive segments 19 of the annular piece 18 that have been shaped and assembled by folding the wall portions 24, 24', and 25 about longitudinal fold lines and by folding down the overlap tab 26 against the outside face of the wall portion 24 that is folded at substantially 90° relative to the stamped strip 22. The segment 19 of the annular piece 18 can be assembled and fixed by applying thrust to press the overlap tab 26 resiliently against the wall portion 24 in a transverse direction. The overlap tab 26 and the wall portion 24 that are in resilient contact are pressed firmly one against the other, thereby enabling the segment 19 of the annular piece 18 to be assembled by transparency welding using a laser beam to make spots or lines of welding in the thickness of the walls 26 and 24.

As shown in FIG. 11, a fold is then made in a fold line joining together two successive stamped strips 22 so as to engage the flaps 27 and 27' of the wall portions 24 and 24' inside the longitudinal ends of other wall portions. It is possible to provide stamped zones for receiving the flaps 27 and 27' in the longitudinal end margins of the wall portions 24 and 24' of the section 21 situated adjacent to the section having the flaps 27 and 27'. The flaps 27 and 27' are folded outwards a little so as to bear resiliently against the insides of the stamped end zones of the walls 24 and 24' of the section 21 adjacent to the section having the flaps 27 and 27' when achieving engagement by pivoting the two sections 21 relative to each other about the fold line joining together the two strips 22.

Similarly, the flap 28 is engaged in a stamped zone of the wall portion 25 of the segment adjacent to the segment having the flap 28. On being engaged, the flap 28 is folded a little towards the inside of the annular piece 18 so as to bear resiliently against the end of the wall portion 25.

The flaps 27, 27', and 28 are maintained bearing resiliently against the engagement zones of the walls of the adjacent segment 19 during welding for assembly purposes.

The flaps 27, 27', and 28 of the successive segments 19 of the device are welded from outside the tubular structure 18 after folding along the fold line between two successive stamped strips 22.

Welding can be performed by transparency using a laser beam, the flaps being held firmly in contact with the ends of the walls of an adjacent segment 19 by resilient urging. In order to encourage contact between the ends of the walls and the flaps it is possible to apply pressure or pinching to the walls in the direction going towards the inside of the tubular structure.

Figure 12:
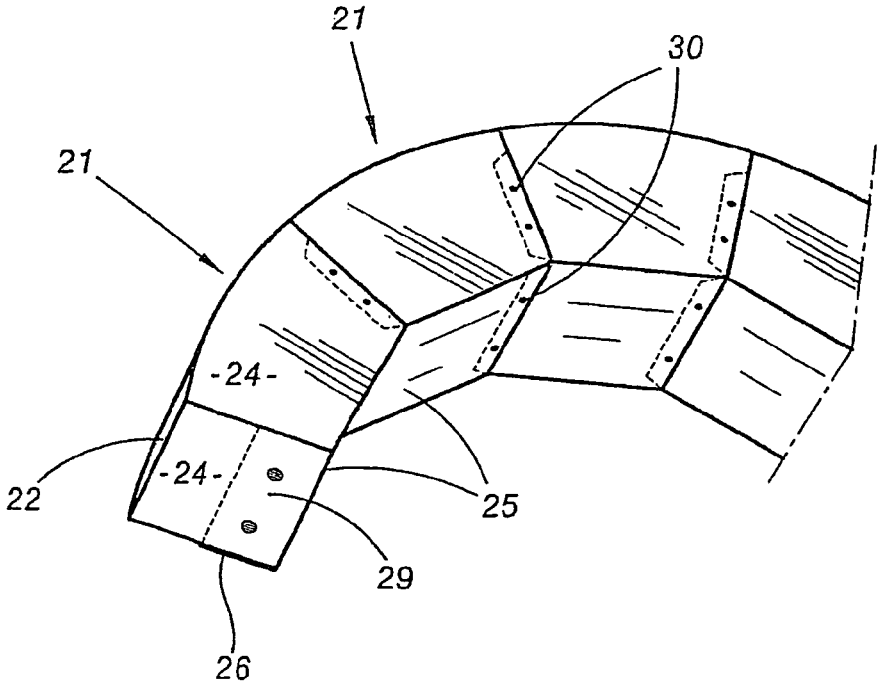

FIG. 12 shows the various laser welded lines or spots 29, 30 serving to assemble two successive segments of tubular shape and to assemble together said two successive segments via their common end.

Preferably, a computer simulation is performed to determine the operational loads on the structural element, in order to discover the zones of the structural element where stress concentrations are lowest. The weld spots or lines are made in the zones determined in this way.

These weld spots or lines are generally made in transparency by laser, however in some cases welds can be made along edges pressed one against the other of a connection tab and a wall portion that are bearing resiliently one against the other, with this method of welding being referred to as clinker building.

It is possible to obtain very good dimensional precision for the structural element, this dimensional precision depending in particular on the precision with which the metal sheet is cut out and folded and on the position in which the overlap tab(s) and the wall portions are held stationary while being welded. Positioning precision during welding is easily obtained since it suffices to position one of the two walls that are to be fixed together by welding, the second wall then pressing against the first wall resiliently.

Assembly can be performed without using a jig inside the tubular structure of the element, thus making it possible to make elements in which the cross-section of the tubular structure varies. The wall portions for welding can be held during welding by simple mechanical devices such as pliers or clamps.

Structural elements of very complex shape can be made, in particular by using computer-aided design software serving to optimize the outline of the metal sheet and its fold lines.

With structural elements of large dimensions, it is possible to make the structural element from a plurality of metal blanks, the various pieces obtained by folding and assembling the different metal blanks subsequently being assembled together by welding operations using overlap tabs and/or walls bearing resiliently against one another.

It is possible to make structural elements that are extremely rigid out of thin sheet metal because of the stiffening effect obtained by welding an overlap tab onto a wall portion or another overlap tab of the structural element. Certain portions of the structural element may be reinforced by superposing an overlap tab on a wall portion, the overlap tab and the wall portion being prevented from moving during welding, e.g. transparency welding.

This makes it possible to manufacture structural elements having wall thicknesses lying in the range 0.05 mm to 1 mm, which is difficult to conceive in the manufacture of generally tubular structural elements of polygonal section on the basis of section members.

As mentioned above, it is possible to make structures that are extremely stiff and strong by using metal blanks of thickness greater than 1 mm, possibly of thickness that is the maximum that can be used with the cutting and folding means available for manufacturing the structural element.

The method of the invention enables structural elements to be made out of any metal, and in particular it enables structural elements to be made out of metals that are difficult to weld such as aluminum and its alloys.

Possible applications for the method of the invention and for the structural elements that can be obtained are extremely numerous.

A few possible applications of the method of the invention and of structural elements made by folding are listed below in various industrial fields. However this list is not limiting.

Structural elements of the invention are characterized by a shape that is generally tubular and preferably of polygonal section having at least two tubular segments that are not in axial alignment, the structural element possibly including curved portions which can be obtained by stamping certain portions of the metal blank prior to the folding operation, it being possible to perform the stamping operation before or after cutting out the metal blank.

Structural elements of the invention of generally tubular shape and of polygonal cross-section are characterized in that they comprise a plurality of wall portions in angular dispositions relative to one another that are joined together by fold lines in a single metal blank and at least one additional overlap and fixing tab of each segment together with at least one additional tab for fixing successive segments together being superposed and fixed together by at least one line or spot of overlap welding, to at least one of a wall portion and a second overlap tab, the structural element as a whole being assembled together and stiffened solely by at least one weld line or spot of at least one overlap tab of each segment and at least one tab for fixing an overlap element in a superposed position bearing resiliently on at least one of the wall portion and the second overlap and fixing tab.

The structural elements of the invention used in the building industry may, for example, be frames used in making the moving or stationary parts of doors or windows. Such frames may have sides of tubular shape and of a variety of cross-sections in order to obtain a decorative effect. Such frames, in particular when they constitute doors, may have a face of rounded shape, and in general, may present curved portions. A structural element of the invention used in the building industry may also constitute a frame for double glazed doors or windows. In this application, a structure made from a folded sheet of metal assembled by welding presents significant advantages over frames of conventional type made up of square section members folded at right angles in the corners of the double-glazing frame. In such prior art frames, the section of the section member is modified to a very great extent by the folding which generally gives rise to folds appearing in the surface of the section member.

Structural elements of the invention may be used for making housings for electrical devices, for example constituting the framework of a cabinet door or the entire housing.

In the field of printing machinery, structural elements of the invention can be used as frames for silkscreen printing.

The invention can also find numerous applications in the fields of building land, water, or air vehicles, structural elements of the invention being suitable for use in making vehicle chassis or hulls, and in particular strong squirrel-cage structures that can be covered in sheet metal.

Structural elements of the invention can also be used for making airframes and in particular airplane fuselages. In such applications, and in particular in aviation applications, it is easy to make structural elements out of light alloys that are difficult to weld, such as alloys of aluminum or titanium.

In general, structural elements of the invention can be used to replace structures of complex shape made using section members of unusual shape.

Implementations of the invention make it possible to avoid manufacturing such expensive section members.

In general, in the field of metal construction, structural elements of the invention find applications as reinforcing and supporting structures that need to present a high level of stiffness and great strength, and possibly also low weight.

In particular, structural elements of the invention may possibly constitute curved section members of possibly varying polygonal section, or ring- or frame-shape structures of hollow section.

Structural elements of the invention may also be used as heat exchangers, for example in radiators or convectors for heating.

In some cases, the tubular structure made in accordance with the invention needs to be closed in leaktight manner. Under such circumstances, continuous weld lines are made between the overlap tabs and the wall portions, and possibly also between certain wall portions.

In general, the structural element of the invention is such that it constitutes a practically continuous hollow body; when the hollow body is looped, it can contain a plane closed line situated entirely inside the hollow body and passing inside each of its segments.

The invention is not limited strictly to the embodiment described in two particular cases.

The metal blank(s) used for manufacturing a structural element of the invention may be a steel blank, in particular a stainless steel blank, or it may be made of any other ferrous alloy or indeed non-ferrous alloy, for example an aluminum alloy.

Welding can be performed by a method other than the method of welding by means of a laser beam, even though the laser beam method presents the advantages mentioned above.

The method of the invention may be used to make elements other than frames or annular pieces of tubular structure.

The method of the invention may be used for making pieces of generally tubular shape and of polygonal section which are not looped, as are frames or annular pieces.

The invention claimed is:

1. A structural element having a metal wall of generally tubular shape and polygonal cross-section, the element consisting of:

at least two segments that are not in axial alignment;

a plurality of wall portions, in angular dispositions relative to one another, that are joined together by fold lines in a single metal blank;

each segment comprising at least one additional overlap and fixing tab for fixing its wall portions together; and at least one segment comprising at least one additional tab for fixing the segments together, said additional overlap and fixing tab of each segment and said additional tab for fixing the segments together being superposed on at least one of a wall portion and a second overlap tab of the element and fixed to said at least one of a wall portion and a second overlap tab of the element solely by at least one weld line or weld spot, the structural element as a whole being assembled together solely by said at least one weld line or weld spot of said at least one overlap and fixing tab of each segment and said at least one weld line or weld spot of at least one tab for fixing the segments together, said at least one overlap and fixing tab of each segment being in a superposed position bearing resiliently on at least one of the wall portion and the second overlap and fixing tab, and said at least one tab for fixing the segments together being in a superposed position bearing resiliently on at least one of the wall portion and the second overlap and fixing tab, whereby the structural element is stiffened, wherein the structural element is a closed hollow body, and wherein the structural element is a complex curved section member of polygonal section, or an annular piece of hollow polygonal section.

* * * * *